US006253585B1

(12) United States Patent
Wright

(10) Patent No.: US 6,253,585 B1
(45) Date of Patent: Jul. 3, 2001

(54) LINT FILTER CONSTRUCTION

(76) Inventor: Joseph F Wright, 3048 Limeklin Pk., North Hills, PA (US) 19038

( * ) Notice: Subject to any disclaimer, the term of this patent is extended or adjusted under 35 U.S.C. 154(b) by 0 days.

(21) Appl. No.: 09/294,876

(22) Filed: Apr. 20, 1999

(51) Int. Cl.[7] ..... D06F 39/10

(52) U.S. Cl. ..... 68/18 F; 68/208; 210/460; 134/111

(58) Field of Search ..... 68/208, 18 F; 137/147, 565, 263; 210/463, 460, 459, 461; 134/111

(56) References Cited

U.S. PATENT DOCUMENTS 150,525 * 5/1874 Carpenter .
243,446 * 6/1881 Haggerty .
3,385,085 * 5/1968 Engel ..... 68/23.5
3,762,565 * 10/1973 Okuniewski et al. .
3,804,258 * 4/1974 Okuniewski et al. .
3,959,138 5/1976 Nichols ..... 210/94
4,566,970 1/1986 Piai et al. ..... 210/409
4,970,880 * 11/1990 Luger .
5,372,718 * 12/1994 Zebian .

* cited by examiner

*Primary Examiner*—Frankie L. Stinson
(74) *Attorney, Agent, or Firm*—Henderson & Strum LLP

(57) ABSTRACT

A lint filter construction 10 for use with the drain outlet 101 of a washing machine 100 wherein the construction 10 includes a filter body unit 11 comprising a sieve-like body member 20 fabricated from a sheet of plastic netting and having an upper portion 22 dimensioned to receive and be captively secured to the drain outlet 101 by a filter attachment unit 12 and further including an enlarged intermediate portion 23 and an enlarged lower portion 24; wherein, the lower portion 24 is further provided with a releasable sealing arrangement 40 for removing trapped lint directly from the bottom of the sieve-like body member 20.

4 Claims, 1 Drawing Sheet

LINT FILTER CONSTRUCTION

BACKGROUND OF THE INVENTION

1. Field of the Invention

The present invention relates to the field of washing machine lint filters in general and in particular to a lint filter having a unique clean out feature.

2. Description of Related Art

As can be seen by reference to the following U.S. Pat. Nos. 4,970,880; 4,906,367; 3,960,733; and 3,959,138, the prior art is replete with myriad and diverse lint filter constructions having flexible netting walls.

While all of the aforementioned prior art constructions are more than adequate for the basic purpose and function for which they have been specifically designed, they are uniformly deficient with respect to their failure to provide a simple, efficient, and practical lint filter construction that provides a unique clean out feature designed so that the lint filter does not have to be removed from the drain outlet and wherein the user is provided with direct access to the heaviest concentration of accumulated lint. As anyone who has used the prior art lint filter constructions is all too well aware, the biggest disadvantage to these devices are the numerous steps that are employed in removing the lint filter from the drain outlet, removing the accumulated lint from within the lint filter and the re-installation of the lint filter on the drain outlet.

As a consequence of the foregoing situation, there has existed a longstanding need for a new and improved lint filter construction that has a built-in clean out feature that does not require the lint filter to be removed from the washing machine drain outlet once the lint filter is installed; and, the provision of such a construction is the stated objective of the present invention.

BRIEF SUMMARY OF THE INVENTION

Briefly stated, the lint filter construction that forms the basis of the present invention comprises in general a filter body unit; a filter attachment unit for securing the filter body unit to a washing machine drain outlet and, a filter clean out unit for providing direct access to the accumulated lint that becomes trapped within the filter body unit.

As will be explained in greater detail further on in the specification, the filter attachment unit includes a releasable coupling member for attaching the upper end of the filter body unit to the drain outlet of a washing machine.

In addition, the filter body unit comprises a contoured sieve-like body member fabricated from flexible plastic netting; wherein, the lint filter body member has an enlarged lint trapping capacity to minimize the frequency of having to clean out the accumulated lint from the interior of the filter body unit.

Futhermore, the filter clean out unit comprises a plastic deformable tongue and groove arrangement commonly employed on plastic storage bags; wherein, the tongue and groove arrangement is disposed on the bottom of the filter body member where the greatest accumulation of trapped lint will be concentrated.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
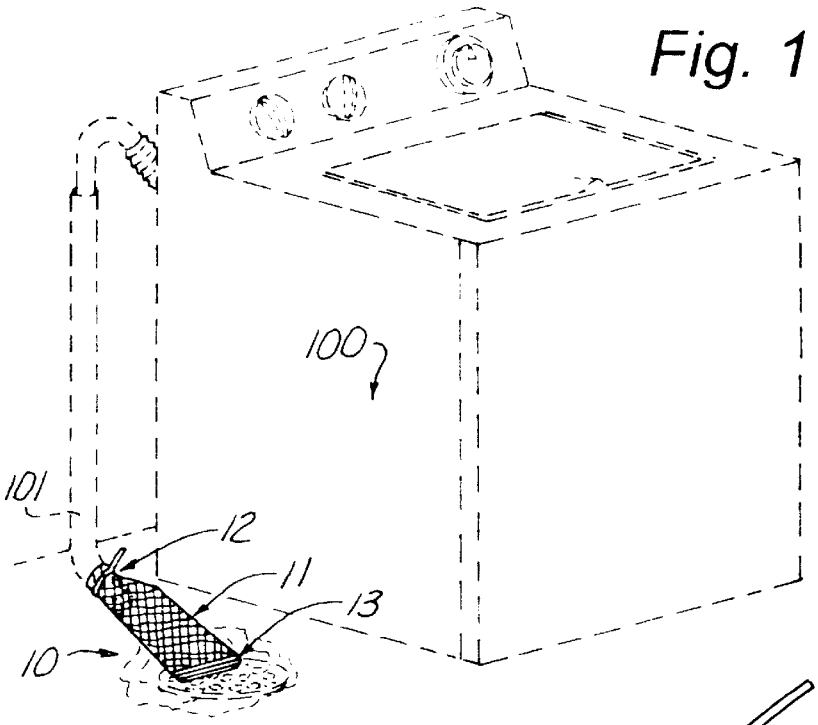
FIG. 1 is a perspective view showing the lint filter construction installed on a washing machine drain outlet.

As can be seen by reference to the drawings, and in particular to FIG. 1, the lint filter construction that forms the basis of the present invention is designated generally by the reference number 10. The construction 10 comprises in general a filter body unit 11, a filter attachment unit 12, and a filter clean out unit 13. These units will now be described in seriatim fashion.

Figure 2:
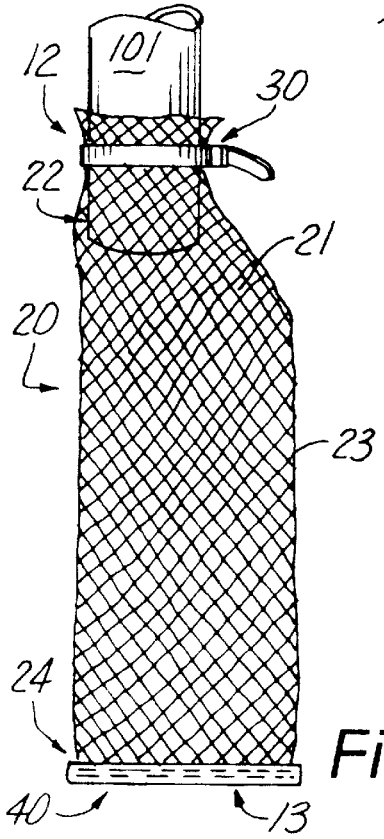
FIG. 2 is a side elevation view of the lint filter construction attached to a drain outlet.

As shown in FIGS. 1 and 2, the filter body unit 11 comprises a contoured sieve like body member 20 fabricated from a sheet of plastic netting 21 and having enlarged intermediate 23 and lower 24 portions and a reduced dimension upper neck portion 22 which is dimensioned to receive the drain outlet 101 of a conventional washing machine 100.

Figure 3:
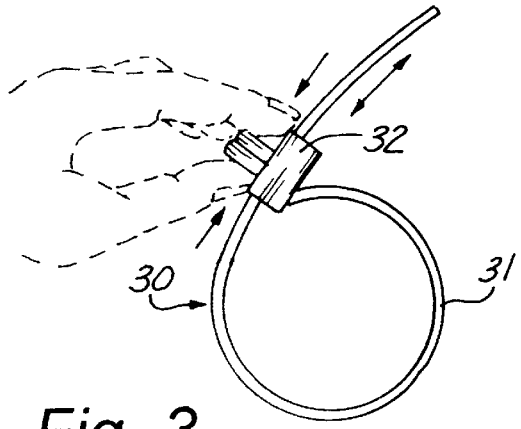
FIG. 3 is an isolated top perspective view of the filter attachment unit.

As can be seen by reference to FIGS. 2 and 3, the filter attachment unit 12 comprises a coupling member 30 which includes a flexible strap element 31 dimensioned to encircle the drain outlet 101 and releasable clasp element 32 operatively associated with the strap element 31 for captively engaging the upper neck portion 22 of the sieve like body member 20 to the drain outlet 101 in a well-recognized fashion.

Figure 5:
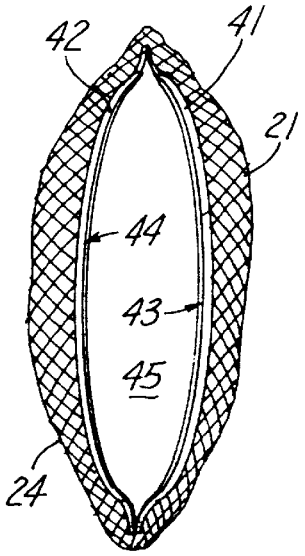
Figure 4:
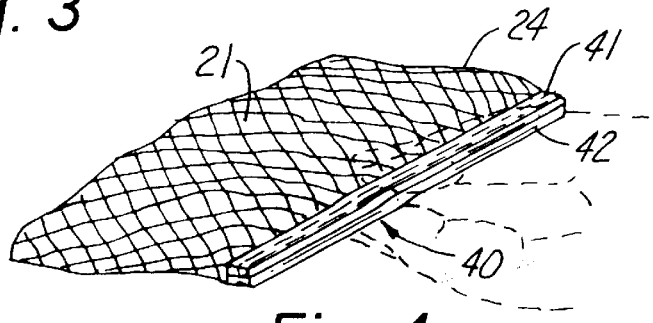
FIG. 4 is a perspective view of the filter clean out unit disposed in the closed position; and, FIG. 5 is a perspective view of the filter clean out unit disposed in the open position.

Turning now to FIGS. 2, 4 and 5, it can be seen that the clean out unit 13 comprises a plastically deformable tongue and groove releasable sealing arrangement designated generally as 40 which is formed on the bottom of the lower portion 24 of the filter body member 20 and defines an opening 45 therein.

As can best be seen by reference to FIG. 5, the releasable sealing arrangement 40 comprises a pair of opposed lip members 41, 42 wherein one of the lip members 41 is provided with an elongated groove 43 and the other lip member 42 is provided with an elongated tongue element 44 that may be plastically deformed to be sealingly engaged in the elongated groove 43 in a well-recognized fashion.

By now, it should be appreciated that the lint filter construction 10 that forms the basis of the present invention, incorporates an enlarged capacity lint filter trap whose upper end 22 may be permanently installed on the washing machine drain outlet 101 due to the fact that the lower end 24 of the enlarged capacity lint trap is provided with the tongue and groove sealing arrangement 40 that is positioned adjacent the point of greatest concentration of the accumulated trapped lint.

As a consequence of this particular arrangement, the user does not have to physically remove the lint trap from the drain outlet 101 in order to clean out the lint trap. All that is required is for the user to open the sealing arrangement 40 at the bottom of the lint trap and a significant amount of trapped lint will fall out of the lint trap under the influence of gravity; whereas, the remainder of the trapped lint will be assisted by gravity once the lint has been dislodged from the interior surfaces of the sieve-like lint filter body member 20.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A lint filter construction for use with the drain outlet of a washing machine wherein the construction consists of:

a filter body unit including a sieve-like body member having an upper portion, an intermediate portion, and a lower portion fabricated from a sheet of generally flexible plastic netting; wherein, the upper portion is dimensioned to receive the drain outlet, a filter attachment unit including a coupling member adapted to captively engage the upper portion of the sieve-like body member to the drain outlet; and a clean-out unit disposed on the lower portion of the sieve-like body member and a plastically deformable tongue and groove releasable sealing arrangement defining an opening in said lower portion which is controlled by said sealing arrangement.

2. The construction as in claim 1; wherein, the upper portion of the sieve like body member defines a reduced diameter neck portion.

3. The construction as in claim 1; wherein, the upper, lower and intermediate portions of the sieve-like body member define an enlarged capacity filter body unit.

4. The construction as in claim 3; wherein, the intermediate and lower portions are enlarged relative to the upper portion.

* * * * *